United States Patent [19]

Finnegan et al.

[11] Patent Number: 4,760,966

[45] Date of Patent: Aug. 2, 1988

[54] METHOD OF COMMINUTING RARE EARTH MAGNET ALLOYS INTO FINE PARTICLES

[75] Inventors: Robert D. Finnegan, W. Long Branch; Joseph P. Klimek, South Amboy, both of N.J.

[73] Assignee: The United States of America as represented by the Secretary of the Army, Washington, D.C.

[21] Appl. No.: 91,697

[22] Filed: Aug. 28, 1987

[51] Int. Cl.[4] ..... B02C 19/12

[52] U.S. Cl. ..... 241/1; 241/29; 241/18

[58] Field of Search ..... 241/1, 29, 5, 301, 23, 241/65, 152 A, 18, 30; 148/101, 105, 120, 121, 122; 423/21.1; 419/33

[56] References Cited

U.S. PATENT DOCUMENTS 4,641,787 2/1987 Petersen et al. ..... 241/5

*Primary Examiner*—Mark Rosenbaum

*Attorney, Agent, or Firm*—Sheldon Kanars; Roy E. Gordon

[57] ABSTRACT

Rare earth magnet alloys are comminuted into fine particles at room temperature up to about 400° C. by placing the alloy into a vessel and pressurizing the vessel, hydriding the alloy, depressurizing the alloy to atmospheric pressure after the absorption of hydrogen and evacuating the vessel so that the absorbed hydrogen is given up leaving microfissures in the alloy, and comminution of the sample.

5 Claims, 4 Drawing Sheets

METHOD OF COMMINUTING RARE EARTH MAGNET ALLOYS INTO FINE PARTICLES

The invention described herein may be manufactured, used, and licensed by or for the Government for governmental purposes without the payment to us of any royalty thereon.

This invention relates to a method of comminuting rare earth magnet alloys into fine particles.

BACKGROUND OF THE INVENTION

There exists a need for a fine particle size in order to sinter rare earth magnets. In the past, the requisite particle size has been obtained using a milling machine to obtain a relatively small particle size of about 37 microns; and then using a jet mill to obtain an even smaller size of about 3 to 10 microns. The difficulty with the foregoing method is that the oxygen and water vapor in the air cause the magnetic material to decompose.

One way of overcoming this has been to use a glove box where all steps are carried out with only minimal oxygen and water vapor present. Such a method however, is laborious and time consuming.

SUMMARY OF THE INVENTION

The general object of this invention is to provide a method of comminuting rare earth magnetic alloys into fine particles. A more specific object of the invention is to provide such a method that will be easily carried out and take a relatively short time.

It has now been found that hydriding can be employed to comminute rare earth magnet alloys into fine particles. More particularly, the rare earth magnet alloy is placed into a vessel, the vessel pressurized, and hydrogen gas is absorbed by the rare-earth magnet alloy at temperatures ranging from room temperature up to 400° C. After the hydrogen is absorbed, the pressure inside the vessel is released and a vacuum is pulled on the sample. The absorbed hydrogen is pulled from the rare earth magnet material, leaving a cracked surface.

To significantly reduce the magnet alloy particle size, sixty to one hundred cycles of pressurization and pulling of vacuum and absorbing and desorbing are required. It is a laborious task to open and close valves manually; therefore, it is quite desirable to have an automated system to perform this function A microprocessor-controlled system has been developed which cycles automatically through the hydriding process thus eliminating an excessive amount of labor and increasing the amount of powdered alloy that can be produced.

DESCRIPTION OF THE DRAWING

Referring to FIG. 1, the microprocessor-controlled system includes a hydrogen gas supply tank, A, a compressor, B, a solenoid control valve for the compressor, C, a solenoid control valve for pressurization, D, a microprocessor, E, a furnace for the vessel, F, a sample vessel pressure gauge, G1, a control gauge for pressurization, G2, a control gauge for exhaust, G3, a vessel with sample, H, a tube to exhaust, I, and a roughing pump, J.

Hydriding is performed by the microprocessor in three steps at room temperature to about 400° C. First, the vessel containing the rare earth material is pressurized so that hydrogen can be absorbed by it. After absorption, the material is depressurized to atmospheric pressure, and the vessel then evacuated so that the absorbed hydrogen will be given up leaving desired microfissures in the alloy.

DESCRIPTION OF THE PREFERRED EMBODIMENT

A rare-earth magnetic alloy as for example $Nd_{14}Fe_{77}B_8$ is placed in a vessel, H that has a capability of withstanding pressures up to 60,000 psi. In turn, the vessel is placed in a tube furnace, F that is heated to a maximum temperature of about 400° C. After the sample vessel, H reaches the desired temperature, the hydriding system is placed under the control of the microprocessor, E, which controls the system by timing the valve openings and closings.

The system is first evacuated when the valve to the roughing pump, J is opened. This valve remains opened for 15 minutes, which is ample time for the system to be evacuated. At the end of this period, the two solenoid valves, C and D, are opened simultaneously: one valve, C, starts the compressor and the other valve, D, allows compressed hydrogen from the compressor into the system, which is then pressurized until the set-point pressure is reached which is between 1000 psi and 4000 psi. A switch shuts off the air supplied to the compressor and the air supplied to open the inlet valve, thereby turning off the compressor and closing the inlet valve. As the rare earth alloy absorbs hydrogen, the pressure in the system falls. When it falls below the set point valve, the switch on the pressure gauge reopens the inlet valve and restarts the compressor, thereby maintaining the set point pressure.

A pressure of 4000 psi is maintained in the vessel for about six minutes. A valve is then opened, and the hydrogen is vented to the exhaust. After another six minute period, the system starts up again.

Figure 1:
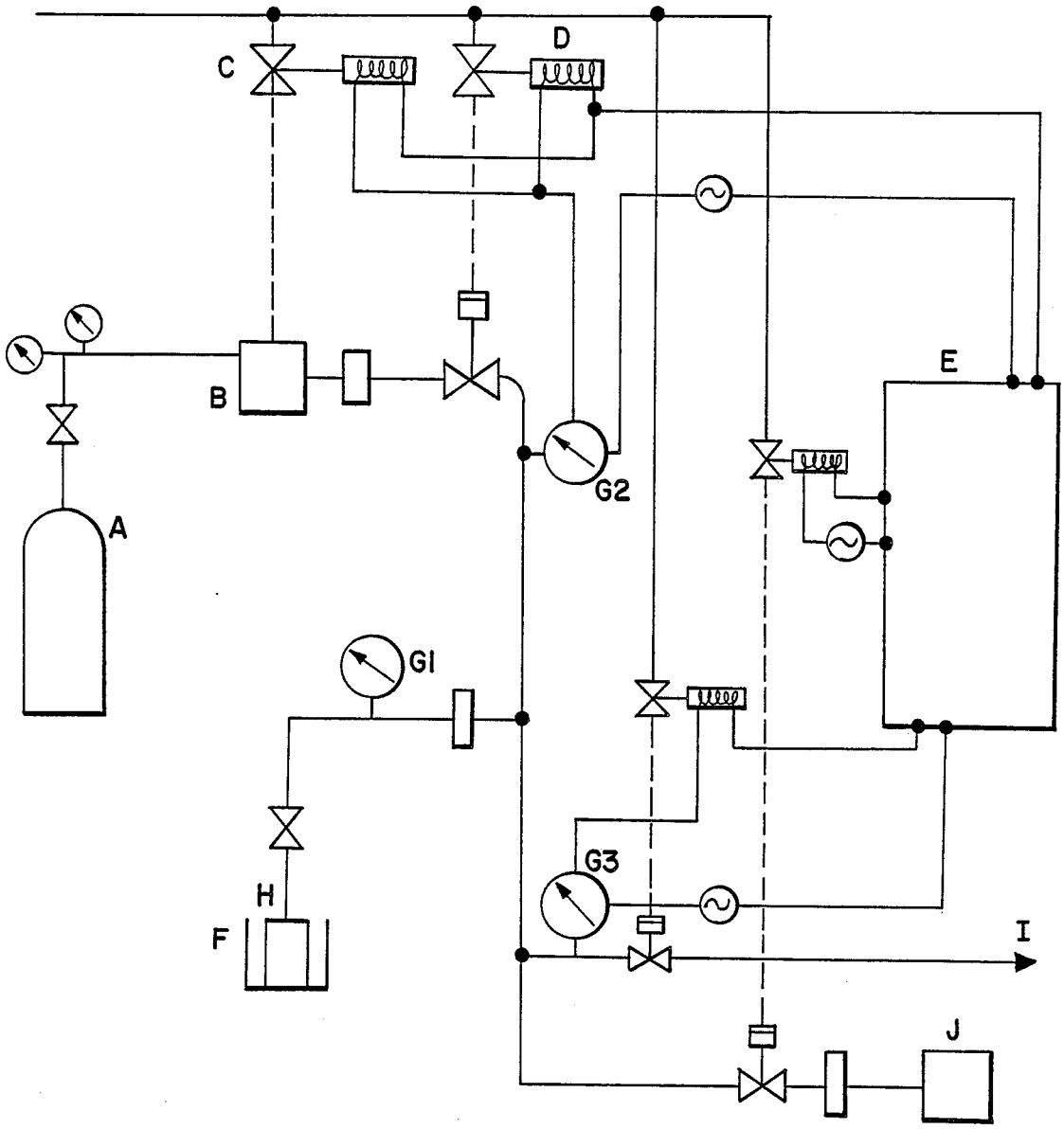
FIG. 1 is a schematic of a microprocessor-controlled system for carrying out the invention.
Figure 2:
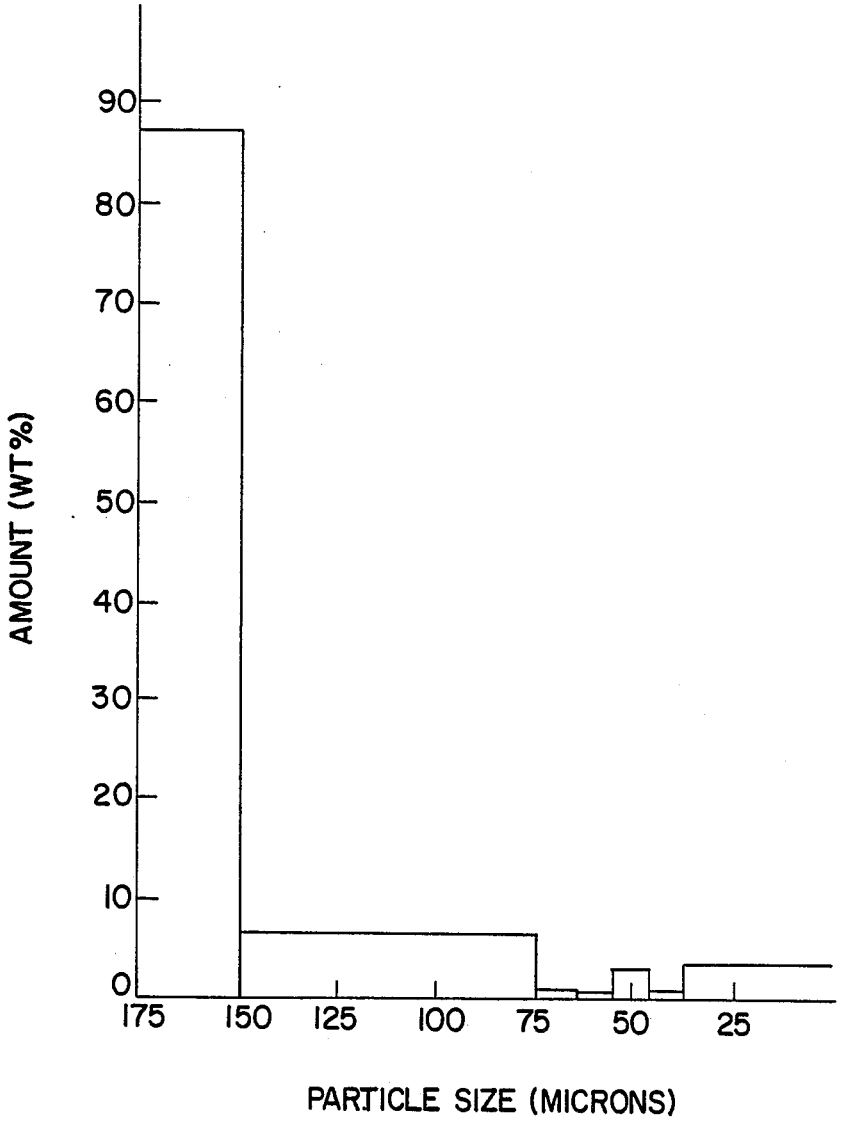
FIG. 2 is a bar graph of size distribution of particles before any hydriding.
Figure 3:
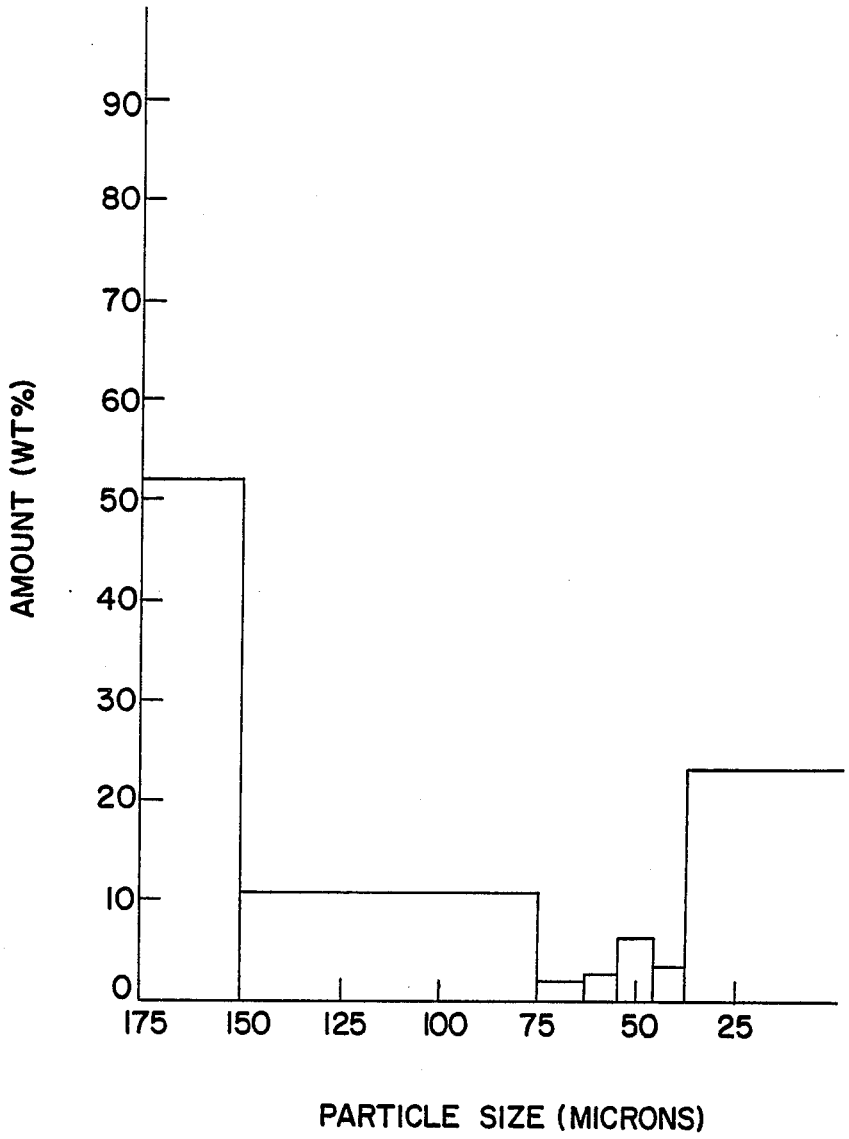
FIG. 3 is a bar graph of size distribution of particles after 62 hydriding cycles.

A typical sieve-result, before and after hydriding, is shown in FIGS. 2 and 3. These figures demonstrate the large increase in particles of the smallest size. These particles nclude all those smaller then 37 microns. The figures show that about 20 percent of the largest particles have been comminuted to sizes of less than 37 microns.

Figure 4:
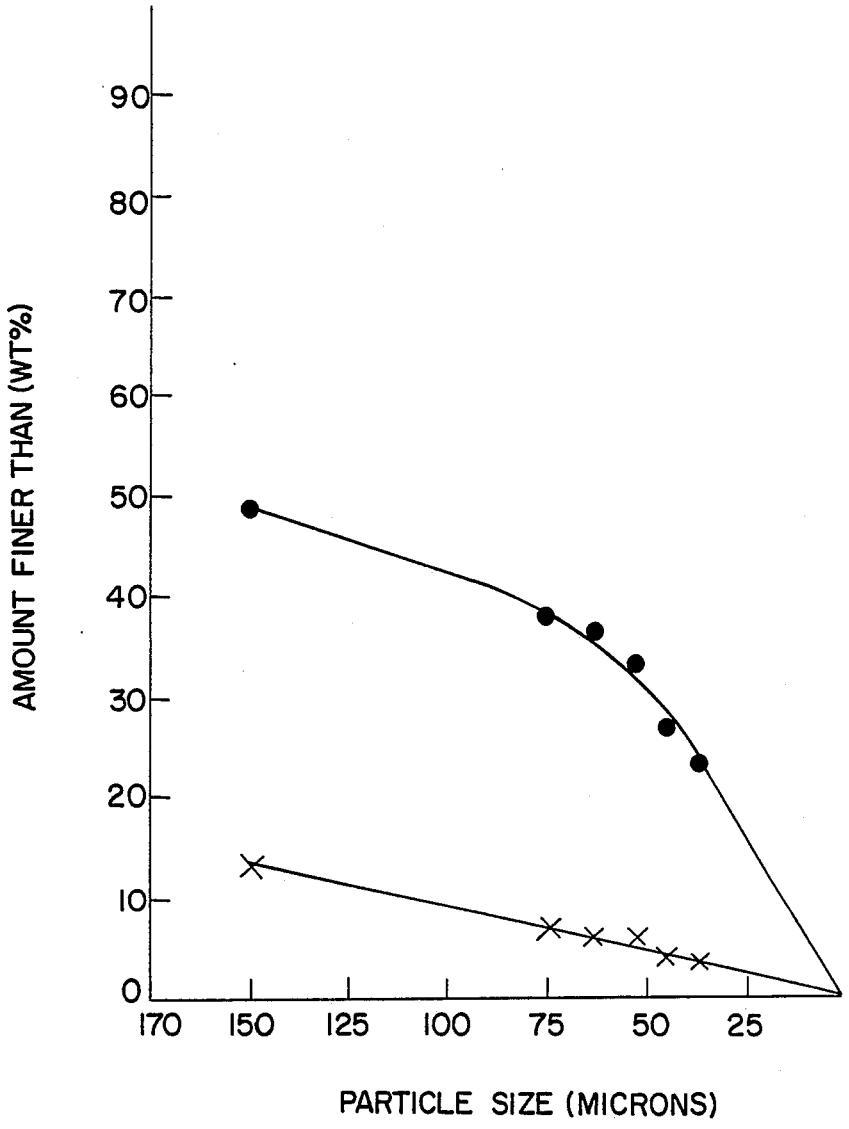
FIG. 4 is a graph of amount finer than: X-before any hydriding and •-after 62 cycles of hydriding.

FIG. 4 shows that comminution through hydriding can cause a significant reduction in the average particle size of a rare earth alloy material. Although this method does not reduce the average particle size enough to allow fabrication of high quality permanent magnets, it is useful as an initial coarse grinding method.

Most rare earth magnetic alloy materials are put through two grinding cycles. The initial grind produces a coarse powder that is placed either in an attrition mill or in a jet mill to be ground into a very fine powder. The hydriding method of comminuting is suitable for the coarse grinding stage and does not contaminate the rare earth magnetic alloy material as much as the traditional method of comminuting, such as milling.

We wish it to be understood that we do not desire to be limited to the exact details of construction as described for obvious modifications will occur to a person skilled in the art.

What is claimed is:

1. Method of comminuting rare earth magnet alloys into fine particles at room temperature up to about 400° C., said method including the steps of:

(A) placing the alloy into a vessel and pressurizing the vessel, (B) hydriding the alloy, (C) depressurizing the alloy to atmospheric pressure after the absorption of hydrogen, and (D) evacuating the vessel so that the absorbed hydrogen is given up leaving microfissures in the alloy, and comminution of the sample alloy.

2. Method according to claim 1 wherein about sixty to one hundred cycles of pressurization and pulling of vacuum and of absorbing and desorbing are carried out.

3. Method according to claim 2 wherein the cycles of absorbing and desorbing are carried out using a microprocessor-controlled system.

4. Method according to claim 3 wherein 20 percent of the larger particles are reduced to less than 37 microns in size.

5. Method according to claim 1 wherein the rare earth magnet alloy comminuted is $Nd_{14}Fe_{77}B_8$.

* * * * *